US008083230B2

(12) United States Patent
Spence

(10) Patent No.: US 8,083,230 B2
(45) Date of Patent: Dec. 27, 2011

(54) BI DIRECTIONAL PAPER HANDLING TRANSPORT

(75) Inventor: James Joseph Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 43 days.

(21) Appl. No.: 12/182,400

(22) Filed: Jul. 30, 2008

(65) Prior Publication Data

US 2009/0283962 A1 Nov. 19, 2009

Related U.S. Application Data

(60) Provisional application No. 61/053,720, filed on May 16, 2008.

(51) Int. Cl.
*B65H 5/02* (2006.01)

(52) U.S. Cl. ..... 271/273

(58) Field of Classification Search ..... 271/225, 271/264, 272–274, 902; 399/124, 364
See application file for complete search history.

(56) References Cited

U.S. PATENT DOCUMENTS

| | | | | | |
|---|---|---|---|---|---|
| 3,287,013 | A * | 11/1966 | Fairbanks et al. | ..... | 226/181 |
| 3,661,383 | A * | 5/1972 | Morrison | ..... | 271/273 |
| 4,885,610 | A * | 12/1989 | Katoh | ..... | 399/215 |
| 5,941,522 | A * | 8/1999 | Hagstrom et al. | ..... | 271/225 |
| 6,089,703 | A * | 7/2000 | Pearson | ..... | 347/102 |
| 6,145,828 | A * | 11/2000 | Arai | ..... | 271/3.03 |
| 6,394,447 | B1 * | 5/2002 | Kawai et al. | ..... | 271/186 |
| 6,719,283 | B2 * | 4/2004 | Tsuchiya et al. | ..... | 270/58.07 |
| 7,245,855 | B2 * | 7/2007 | Yasumoto | ..... | 399/124 |
| 7,366,442 | B2 * | 4/2008 | Ishii et al. | ..... | 399/122 |
| 2004/0042819 | A1 * | 3/2004 | Kobayashi | ..... | 399/124 |
| 2008/0050149 | A1 * | 2/2008 | Parks et al. | ..... | 399/124 |

* cited by examiner

*Primary Examiner* — Jeremy R Severson
(74) *Attorney, Agent, or Firm* — Fay Sharpe LLP

(57) ABSTRACT

A method and apparatus for bi-directionally transporting sheet stock in a marking engine by disposing idler rolls on opposite sides of a drive roll on movable idler roll decks for forming forward and reverse nips and feeding sheets from opposite directions into the nips and providing for moving the idler rolls away from opposite sides of the drive roll for jam clearance.

5 Claims, 10 Drawing Sheets

BI DIRECTIONAL PAPER HANDLING TRANSPORT

BACKGROUND

The present disclosure relates to transport of print media and particularly print media in sheet form as is employed in photocopiers and office printers. The disclosure particularly relates to digital image printing in print engines arranged for parallel processing, as for example, printing in plural print engines and for duplex printing on both sides of a print media sheet.

In print engines arranged for parallel processing, it is often the case that the transport of sheet print media will by-pass one or more print engines in order to print concurrently on another print engine. However, the transport path must also include a provision for reversing the direction and movement of the sheet print media for duplex printing. Thus, the transporters propelling the sheets for moving the sheet print media through the designated path must provide for bi directional movement. Heretofore, such bi directional print sheet media movement has been provided by individual transporters disposed in the media path with one transporter arranged to provide print sheet media movement in a forward direction such as for bypass and simplex printing, and another transporter disposed to arrange for print sheet media movement in the reverse direction such as for duplex printing. The transporters are typically each comprised of a series of nip rollers driven by a belt powered by an individual single direction of rotation drive motor. Thus, the functionality of bi directional print sheet media movement in a print engine has been somewhat complex and costly because of the need for plural print sheet media transporters.

It has therefore been desired to reduce the complexity and cost of a sheet transport digital print engine arrangement for parallel printing employing bypass capability and providing for duplex printing on opposite sides of print sheet media.

BRIEF DESCRIPTION

The present disclosure describes a print sheet media transporter for providing movement of sheets through a transport or printing path and particularly for bi directional transport in digital print engines. The single bi directional transporter employs a single drive motor rotating in one direction for driving a belt which is connected to a plurality of spaced drive rolls, each of which has idler rolls disposed on opposite sides thereof for rotating the idler rolls in opposite directions. The combination of the drive roll and oppositely disposed idler rolls forms a pair of nips which are capable of propelling the print sheet media in opposite directions when fed to the oppositely disposed nips. The bi directional print transporter of the present disclosure thus replaces two separately driven unidirectional print sheet media transporters thereby reducing the complexity and cost of the equipment.

DETAILED DESCRIPTION

Figure 8:
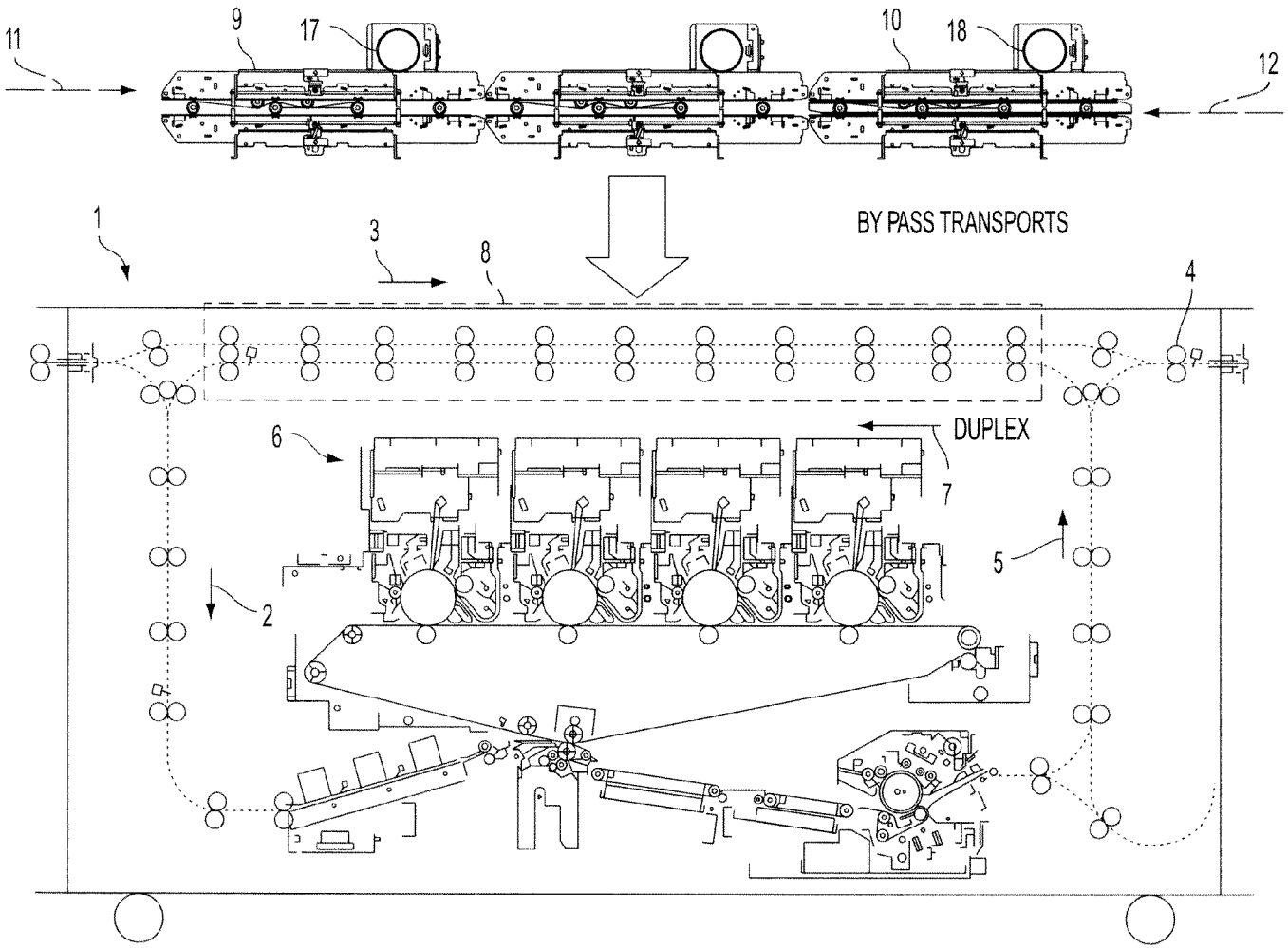
FIG. 8 PRIOR ART
FIG. 8 is a view similar to FIG. 1 showing the arrangement of the plural unidirectional print sheet media transporters of the prior art equipment.
Figure 9:
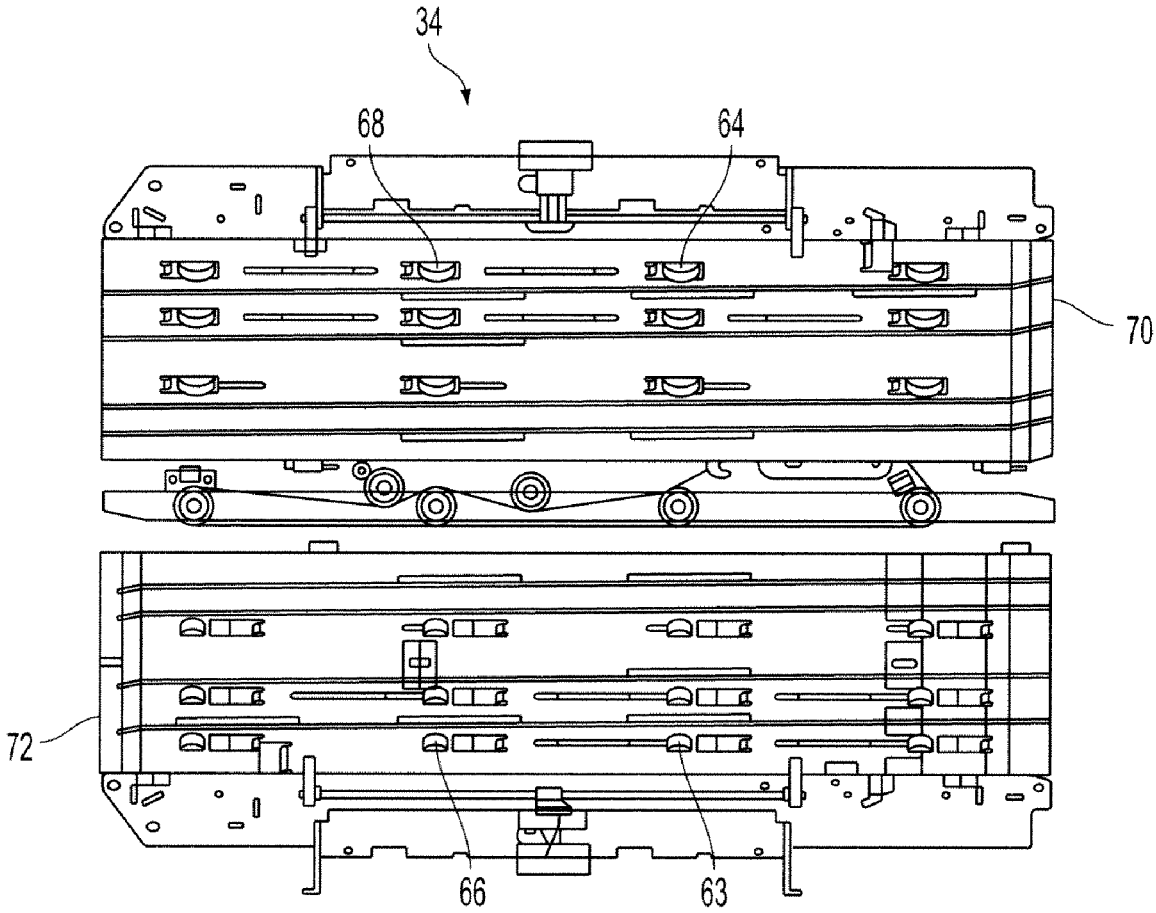
FIG. 9 is a side view of the transporter of the present disclosure with the idler roller deck shown open; and, FIG. 10 is a perspective view of the transporter of FIG. 9 in the open condition.
Figure 10:
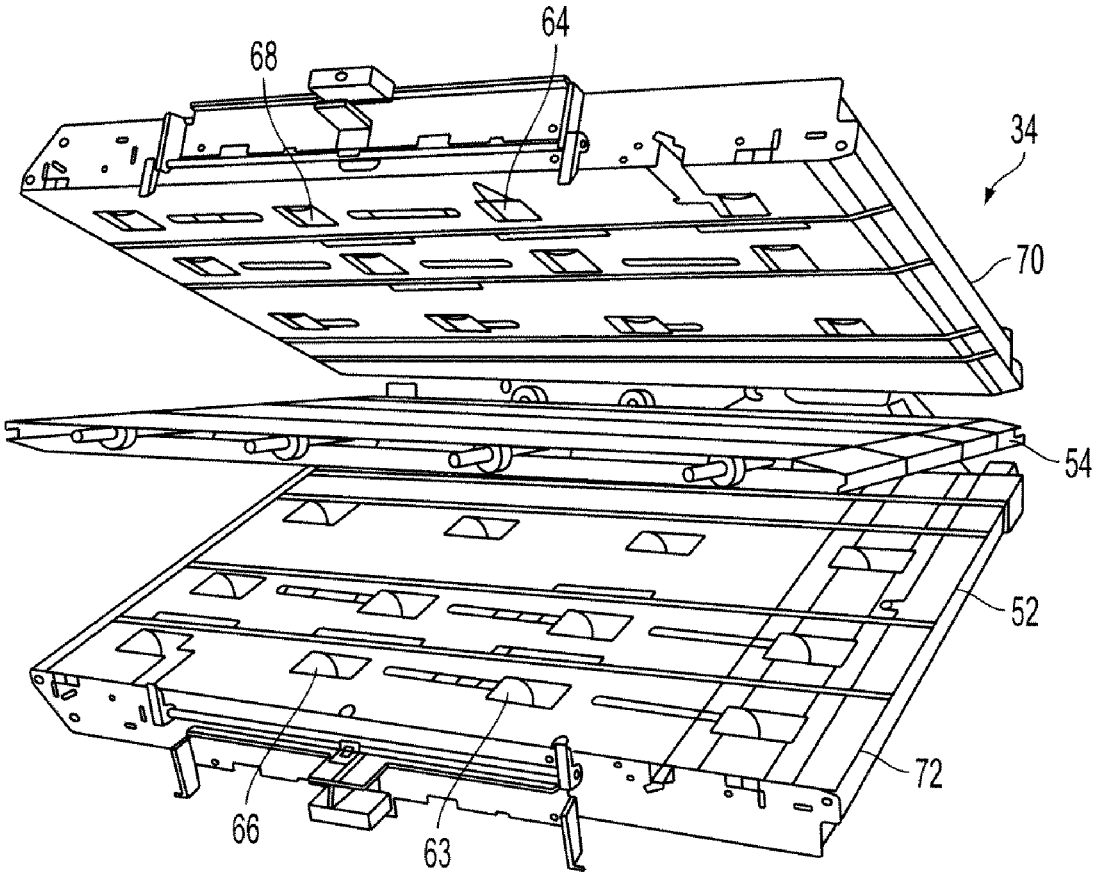

Referring to FIG. 8, a known arrangement for a digital print engine is indicated generally at 1 and includes an incoming print sheet media path for the printing function in the engine 1 as denoted by the dashed line adjacent the black arrow 2. The engine 1 includes a print media sheet bypass path indicated in dashed outline adjacent the black arrow 3 for bypassing the engine 1 and transporting the print sheet media outwardly through the discharge rollers 4. For the printing function, the print sheet media is processed through the print engine and is subsequently fed along the path indicated in dashed outline adjacent the black arrow 5. The print engine may include multiple print heads or photoreceptors indicated generally at 6 for marking primary colors to effect color printing. Upon completion of the printing function and movement along the path in the direction indicated by the arrow 5, the print media is discharged through the rollers 4 in the case of simplex printing. For effecting duplex printing, the print sheet media is transported along the path shown in dashed outline in a reversed direction as indicated by the adjacent black arrow 7 for recycling through the path 2 and printing on the opposite side of the print sheet media. The transporters for effecting the movement of the print sheet media in either the printing or transport mode are shown in the box 8 which contains a plurality of transporters 9, 10 arranged serially, with one of the transporters 9 operative for effecting movement of the print sheet media in the forward direction as denoted by the dashed arrow 11. Whereas, the separate transporter 10 is operative for effecting movement of the print sheet media in the reverse direction indicated by the dashed arrow 12 for effecting duplex printing. Each of the transporters 9, 10 has its own individual drive motor denoted 17, 18 respectively.

Figure 7A:
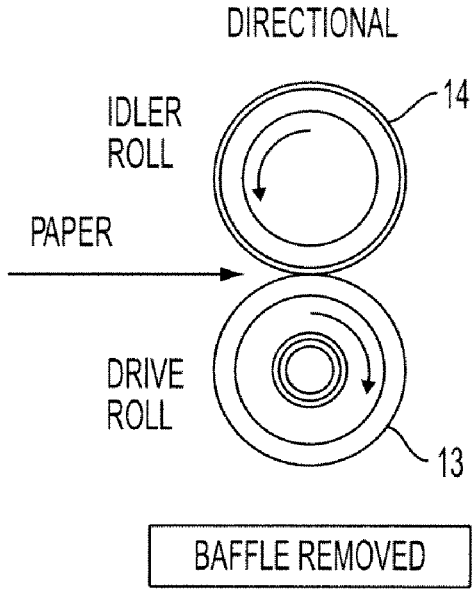
FIG. 7A PRIOR ART
FIGS. 7A and 7B are view similar to FIG. 6 showing the unidirectional nip arrangement of prior art print sheet media transporter.

Referring to FIG. 7A, the nip roller drive arrangement of the prior art transporter 9 of FIG. 8 is shown wherein the belt driven drive roll 13 cooperates with an idler roller 14 for propelling the print sheet media (paper) in the forward direction.

Figure 7B:
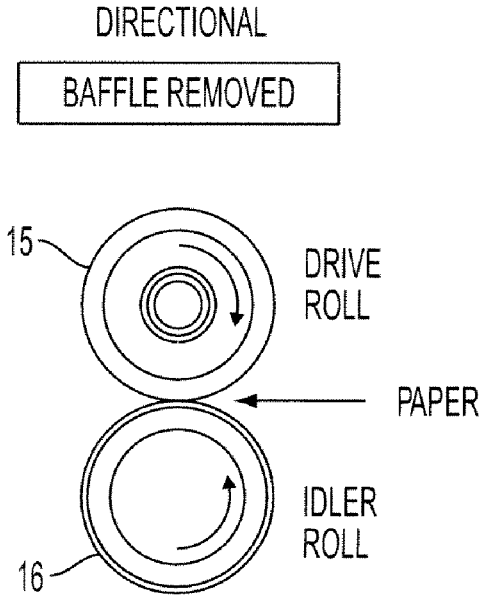
FIG. 7B PRIOR ART

Referring to FIG. 7B, the nip roller arrangement of the prior art transporter 10 of FIG. 8 is shown wherein a motor driven drive roll 15 cooperates with an idler roll 16 for propelling the print sheet media (paper) in a reverse direction.

Figure 1:
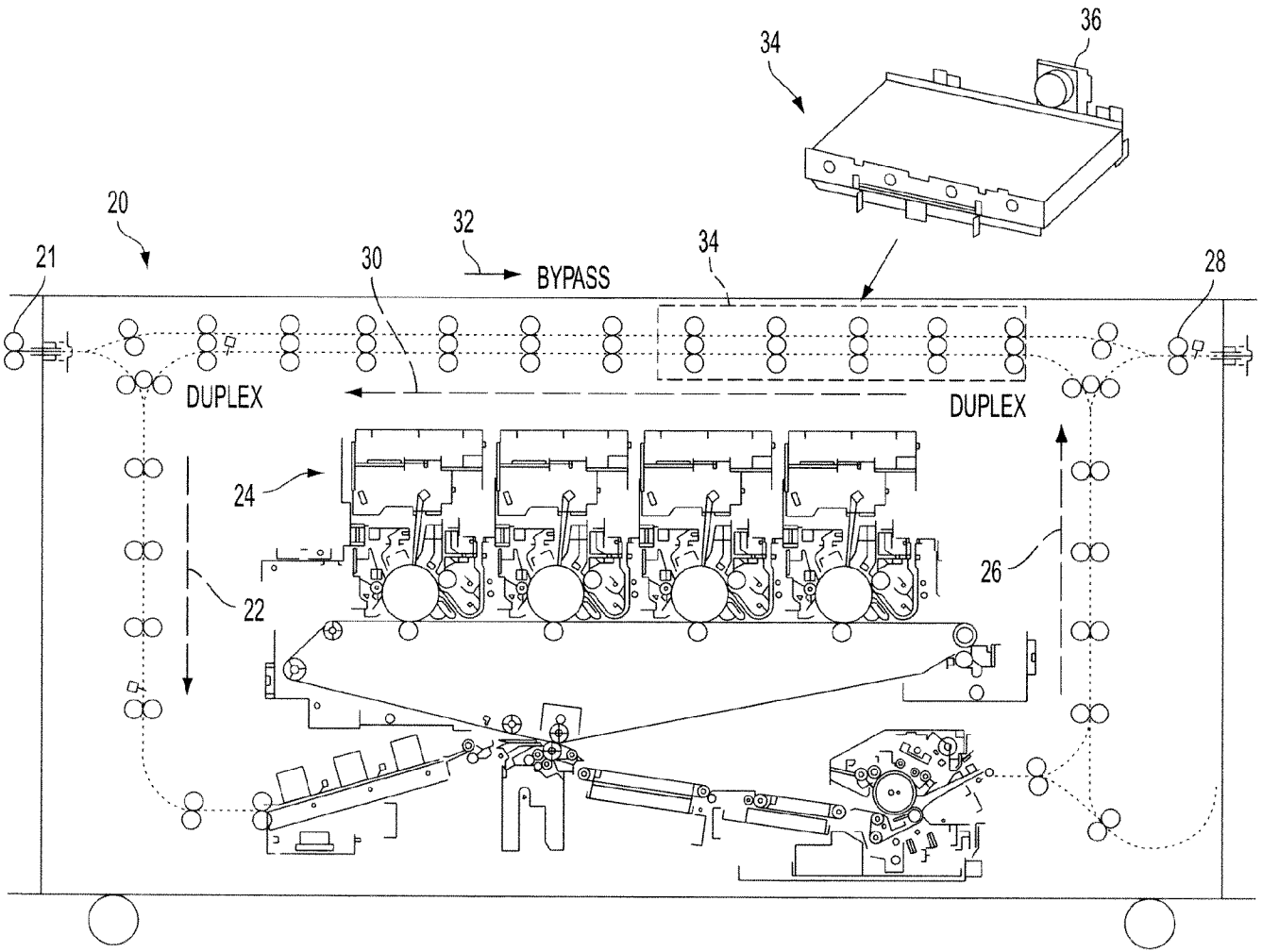
FIG. 1 is a pictorial view of a digital printing arrangement with multiple print engines and illustrates the path of movement of the print sheet media for both printing and bypass transport.

Referring FIG. 1, a digital print engine indicated generally at 20 according to the present disclosure is operative to receive print sheet media from a sheet feeder (not shown) through entrance nip rollers 21 along a path indicated by dashed line adjacent the dashed black arrow 22 for feeding paper through the print engine and outputting the paper along the path indicated by the dashed outline denoted by the dashed black arrow 26. The print engine 20 may include plural print heads or photoreceptors for color printing as indicated generally at 24. The paper may either be discharged through the nip rollers 28 in the case of simplex printing or sent along a reverse path indicated by the dashed black arrow 30 and recycled along the path adjacent arrow 22 for duplex printing on the opposite side of the paper. The print engine 20 also includes a path for bypassing the printing function along a dashed outline path adjacent the black arrow denoted 32 wherein the paper proceeds directly from the inlet to the discharge rollers 28. The print engine 20 has the single transporter enclosed in a dashed box indicated generally at 34 which is operative to effect the bi directional movement of the paper feed with a single drive motor 36 illustrated in FIG. 1 in the reduced size perspective view of the transporter 34.

Figure 2:
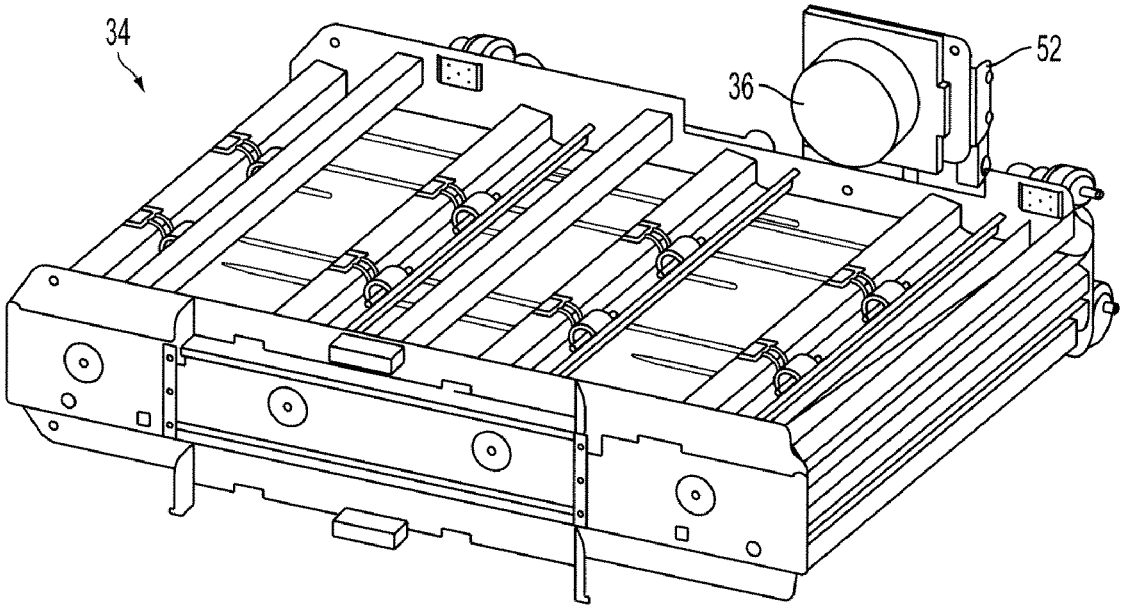
FIG. 2 is a perspective view of the bi directional transporter of the present disclosure.

Referring to FIG. 2, the bi directional transporter 34 of the present disclosure is shown with one single direction of rotation drive motor 36 for effecting the bi directional movement of the print sheet media through the mechanism.

Figure 3:
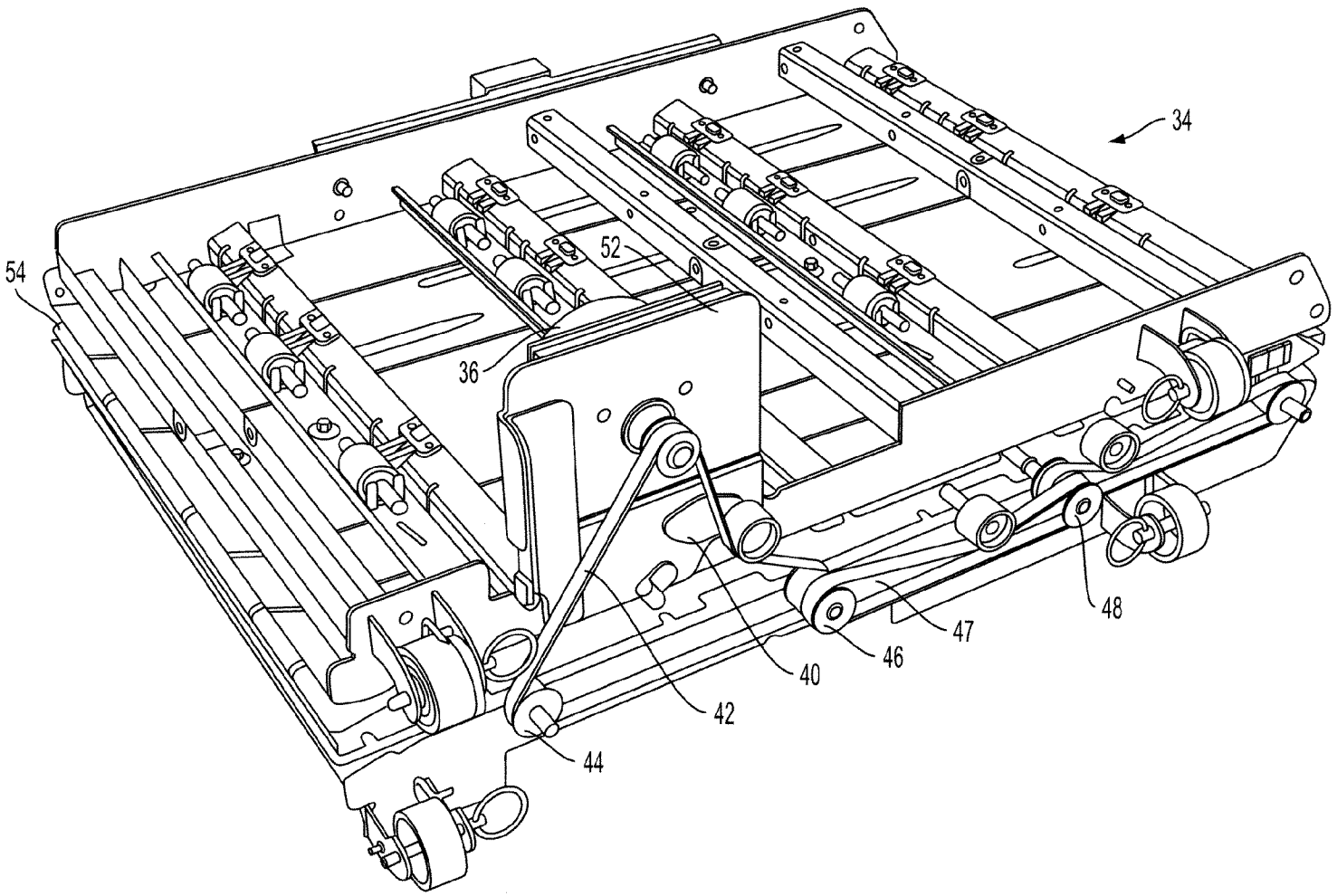
FIG. 3 is a perspective view of the transporter of FIG. 2 taken from the back or motor drive side thereof.
Figure 4:
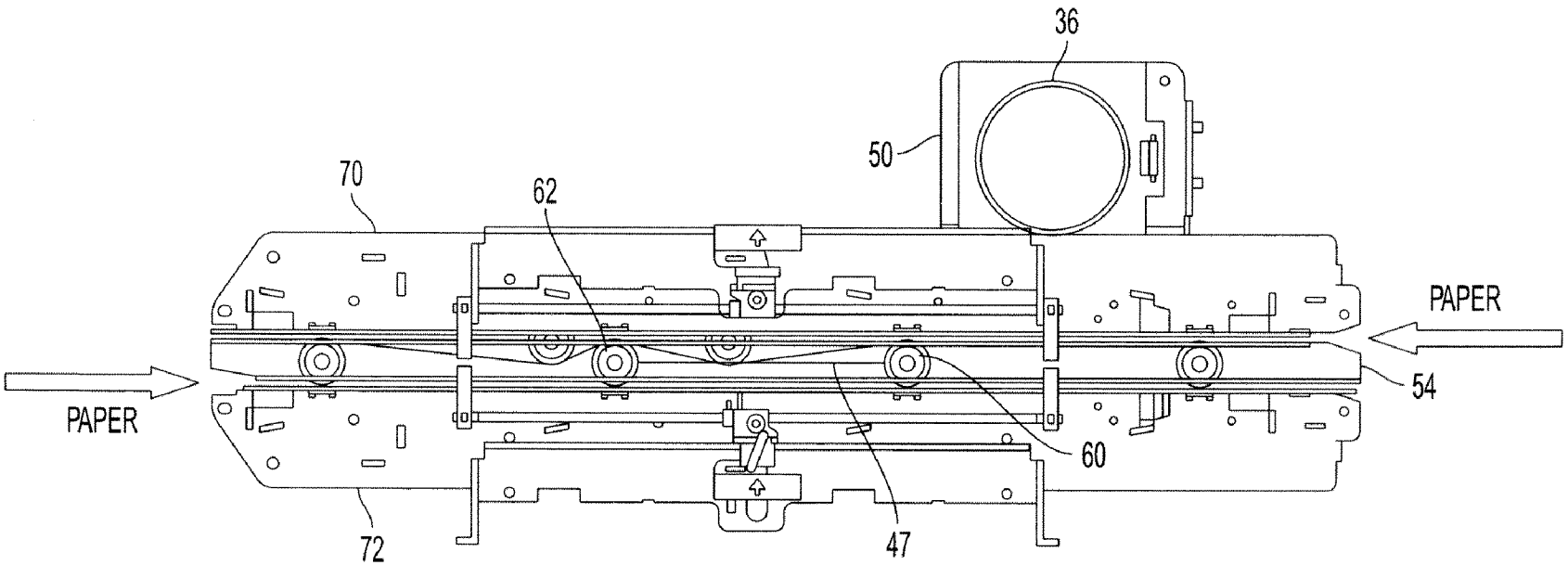
FIG. 4 is a view illustrating the bi directional paper paths through the transporter of FIG. 2.
Figure 5:
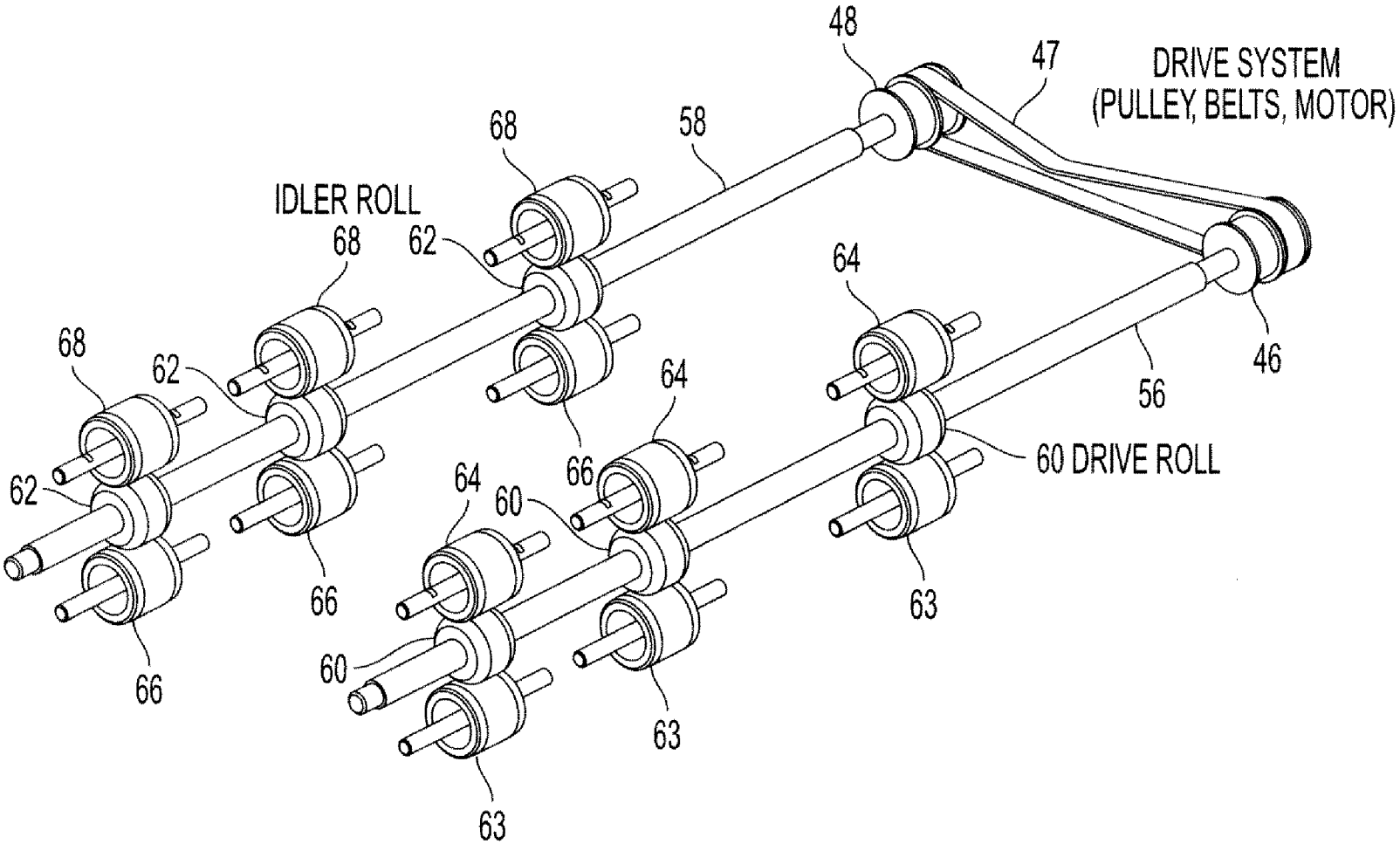
FIG. 5 is a perspective view of two of the drive rolls and associated oppositely disposed idler rollers of the transporter of the present disclosure.

Referring to FIG. 3, the transporter 34 is shown in perspective view from the motor side with the cover removed to show the motor drive shaft 40 with a belt 42 engaged therewith for driving shaft pulleys 44, 46 respectively. A second belt 47 is disposed over shaft pulley 46 and a third spaced shaft pulley 48.

Referring to FIGS. 3, 5, 9 and 10, the motor 36 of the bi directional transporter 34 is mounted on a plate 52 attached to a platform or deck 54 upon which the shafts driven by pulleys 44, 46, 48 are mounted. The shaft pulleys 46, 48 respectively connected to drive shafts 56, 58 which have mounted respectively thereon a plurality of axially spaced drive rolls 60, 62.

Figure 6:
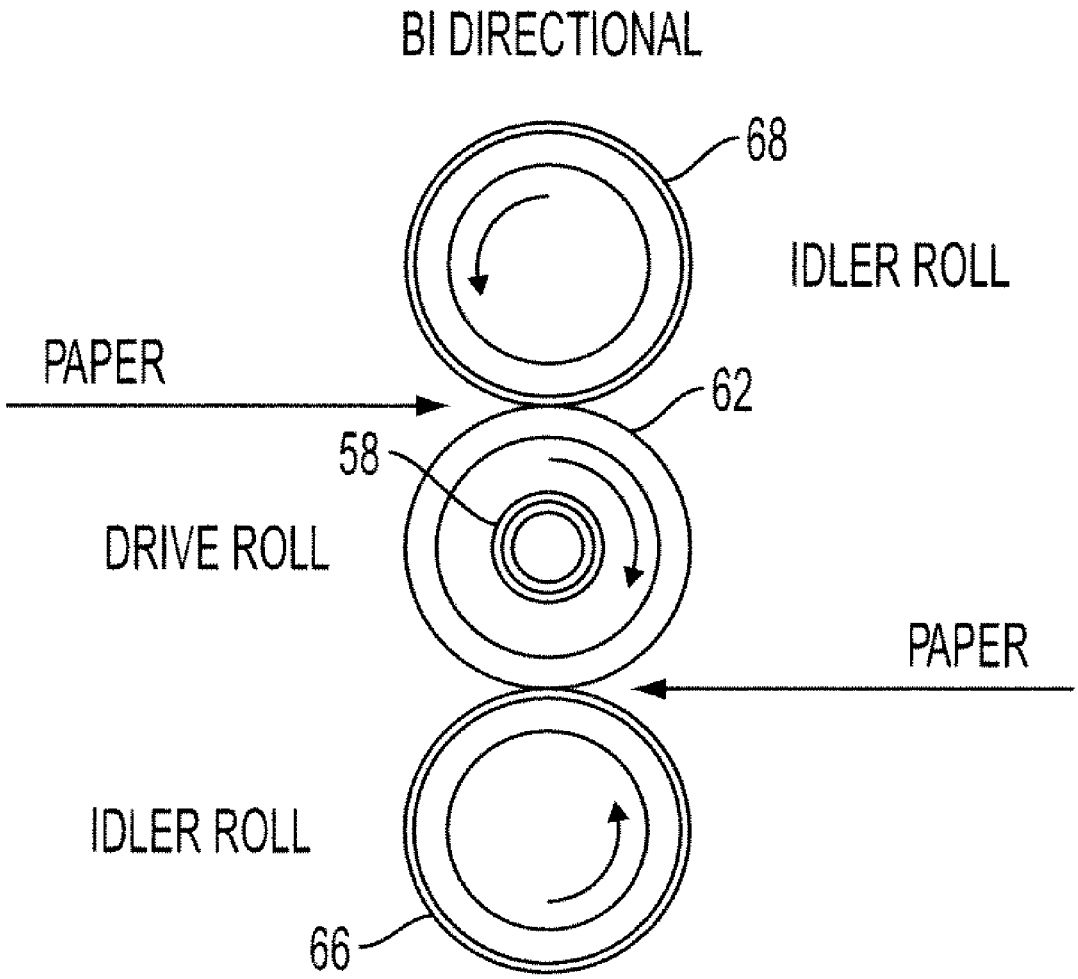
FIG. 6 is an enlarged detailed view of one of the drive rolls and idlers of FIG. 5.

Each of the drive rolls 60, 62 has disposed on opposite sides thereof idler rolls denoted respectively 62, 64 for shaft 56 and 66, 68 for shaft 58. One set of idler rolls for shaft 58 is shown in greater detail in FIG. 6 in which the black arrows indicate the path of the bi directional paper feed.

The transporter 34 may have a modular construction wherein the idler rollers 64, 68 for shafts 56 and 58 respectively and similarly for idler rollers provided on the shaft connected to pulley 44 are mounted on an upper platform 70. The idler rollers 62, 66 and similar idler rollers for the shaft 44 are mounted on a lower platform or deck 72 which platforms 70, 72 may be opened from the drive roll deck 54 for jam clearance.

The present disclosure thus describes a bi directional feed sheet print media transporter which provides the bi directional movement of the print sheet media with only a single drive motor rotating in one direction. The transporter of the present disclosure thus provides less complexity and lower cost for a digital print engine employing sheet print media where bi directional sheet transport is required.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of bi directionally transporting sheet print media in a print/marking engine comprising:

(a) providing a stationary drive deck with a single drive motor and energizing the motor for rotation;

(b) connecting the drive motor for effecting rotation in one direction a plurality of spaced drive rolls all disposed on the stationary deck;

(c) disposing a first and second nip idler roll respectively on opposite sides of each drive roll;

(d) feeding sheet print media from opposite directions respectively to the first and second nip idler rolls and transporting sheets therethrough in opposite direction wherein; the step of disposing a first and second idler roll includes mounting the first nip idler roll for each of the drive rolls on a first idler deck and mounting the second nip idler roll for each drive roll on a second idler deck; and, disposing the idler decks respectively on opposite sides of the stationary deck and moving the first and second idler decks in opposite directions away from the drive deck for enabling paper jam clearance.

2. The method defined in claim 1, wherein the step of effecting rotation includes driving at least two of the plurality of drive rolls with a common drive belt.

3. A transporter for moving sheet print media in opposite directions in a print/marking engine comprising:

(a) a stationary drive deck with a single drive motor thereon rotatable only in one direction;

(b) a plurality of drive rolls all mounted on the stationary deck and operatively connected for rotation in a certain direction by the motor; and, (c) a first and second nip idler roll disposed respectively on opposite sides of each drive roll; wherein, upon feeding sheet print media to the nip idler rolls from opposite sides, the sheets transported through the rolls in opposite directions; and wherein the first and second nip roller are mounted respectively on a first and second idler deck disposed respectively on opposite sides of the stationary deck, the first and second idler deck movable respectively in opposite directions away from the drive rolls for jam clearance.

4. The transporter defined in claim 3, wherein at least two of the drive rolls are driven from the motor by a common belt.

5. The transporter of claim 3, wherein the first and second idler deck are pivoted.

* * * * *